US005939716A

United States Patent [19]

Neal

[11] Patent Number: 5,939,716

[45] Date of Patent: Aug. 17, 1999

[54] THREE-DIMENSIONAL LIGHT TRAP FOR REFLECTIVE PARTICLES

[75] Inventor: Daniel R. Neal, Tijeras, N.Mex.

[73] Assignee: Sandia Corporation, Albuquerque, N.Mex.

[21] Appl. No.: 08/832,144

[22] Filed: Apr. 2, 1997

[51] Int. Cl.[6] ..... H05H 3/04

[52] U.S. Cl. ..... 250/251

[58] Field of Search ..... 250/251

[56] References Cited

U.S. PATENT DOCUMENTS

| | | | |
|---|---|---|---|
| 3,710,279 | 1/1973 | Ashkin | 250/251 |
| 3,808,550 | 4/1974 | Ashkin | 250/251 |
| 4,092,535 | 5/1978 | Ashkin et al. | 250/251 |
| 4,893,886 | 1/1990 | Ashkin et al. | 350/1.1 |
| 5,206,504 | 4/1993 | Sridharan | 250/251 |
| 5,212,382 | 5/1993 | Sasaki et al. | 250/251 |

OTHER PUBLICATIONS

Ashkin, A., "Acceleration and Trapping of Particles by Radiation Pressure," *Physical Review Letters*, vol. 24, No. 4, pp. 156–159 (Jan. 1970).

Ashkin, A., et al., "Optical Trapping and Manipulation of Viruses and Bacteria," *Science Reports*, vol. 235, pp. 1517–1520 (Mar. 1987).

Ashkin, A., et al., "Optical Trapping and Manipulation of Single Cells Using Infrared Laser Beams," *Letters to Nature*, vol. 330 No. 24, pp. 769–771 (Dec. 1987).

Neal, D.R., et al., "A Multi–Tiered Wavefront Sensor Using Binary Optics," *Soc. of Photo–Optical Instr. Engineers*, vol. 2201, pp. 574–585 (Mar. 1994).

Roosen, G., et al., "The $Tem_{01}$ Mode Laser Beam—A Powerful Tool for Optical Levitation of Various Types of Spheres," *Optics Communications*, vol. 26, No. 3, pp. 432–436 (Sep. 1978).

Svoboda, K., et al., "Optical Trapping of Metallic Rayleigh Particles," *Optics Letters*, vol. 19, No. 13, pp. 930–932 (Jul. 1994).

*Primary Examiner*—Bruce Anderson

*Attorney, Agent, or Firm*—George H. Libman

[57] ABSTRACT

A system for containing either a reflective particle or a particle having an index of refraction lower than that of the surrounding media in a three-dimensional light cage. A light beam from a single source illuminates an optics system and generates a set of at least three discrete focussed beams that emanate from a single exit aperture and focus on to a focal plane located close to the particle. The set of focal spots defines a ring that surrounds the particle. The set of focussed beams creates a "light cage" and circumscribes a zone of no light within which the particle lies. The surrounding beams apply constraining forces (created by radiation pressure) to the particle, thereby containing it in a three-dimensional force field trap. A diffractive element, such as an aperture multiplexed lens, or either a Dammann grating or phase element in combination with a focusing lens, may be used to generate the beams. A zoom lens may be used to adjust the size of the light cage, permitting particles of various sizes to be captured and contained.

19 Claims, 10 Drawing Sheets

Focal plane

Lenslet array

THREE-DIMENSIONAL LIGHT TRAP FOR REFLECTIVE PARTICLES

GOVERNMENT RIGHTS

The Government has rights to this invention pursuant to Contract No. DE-AC04-94AL85000 awarded by the U.S. Department of Energy.

BACKGROUND OF THE INVENTION

1. Field of the Invention (Technical Field)

The present invention relates to three-dimensional light traps for reflective particles.

2. Background Art

The last few decades have brought about a revolution in our understanding of physical processes at the microscopic level in virtually every scientific discipline. The impact of this upheaval has perhaps been greatest in the area of molecular biology. For example, even our perception of how life itself is constituted at the physical level has changed radically with the discovery and then characterization of DNA. Research into biological systems has been motivated at least in part by a desire to better understand how to treat and cure disease and extend human life. These research advances have been made possible by a concurrent revolution in biological instrumentation. As in any scientific field, there has been a synergism between instrumentation and research, with new analytical tools opening up new possibilities for research, and new scientific discoveries and theories driving the demand for more powerful, more sensitive, and novel scientific instrumentation.

Research at the microscopic level in biological systems has been hampered by the fact that it is often difficult in practice to isolate a biological particle of interest from the laboratory environment or contaminants. Significant progress is being made in this area, however, thanks to the advent of a technique known as "optical trapping." This technique uses light particles, or photons, to hold or "trap" small particles of transparent or semi-transparent matter.

Optical trapping is based on the principle of conservation of momentum and is illustrated in FIG. 1(*a*), which illustrates the case of a small, spherical transparent particle in the presence of nonuniform photon flux, such as the gaussian distribution of a laser beam. For a transparent particle, the fraction of light which is scattered is typically small, and most of the light will be refracted through the particle instead. If the index of refraction of the particle is greater than that of the surrounding medium, then the light rays will be refracted towards the normal of the surface as they enter the particle, and away from the normal as they exit it, in accordance with standard geometrical optical theory. The light has undergone a net change in direction, and thus there has been a net change in the photons' momentum. This is illustrated for photons entering the right hand side of the particle by the vector inset in FIG. 1(*a*), where the initial and final momenta are designated by the subscripts i and f, respectively. Since momentum must always be conserved, the resulting change in a photon's momentum must be compensated for by an equal and opposite change in the momentum of the particle itself. For the vector inset in FIG. 1*a*, this corresponds to a net change in the momentum of the particle to the right, indicated by the vector labeled "reaction force." Of course, light rays entering the left hand side of the particle have the opposite effect, i.e., they tend to push the particle to the left. If the photon flux were homogeneous, then these effects would cancel each other out completely, and the particle would not experience any net push to the right or left. In the case of a light gradient assumed here, however, there is a net change in the particle's momentum towards the center of the light beam. Clearly, a stronger field will produce a proportionally greater trapping effect.

In addition to the two dimensional (or lateral) trapping force discussed above, there is an additional force which is longitudinal in orientation. FIG. 1(*b*) shows how the direction of light rays changes when a refracting particle is situated near the beam focus. A straightforward momentum conservation (vector) analysis analogous to the one done in connection with FIG. 1(*a*) shows that the reaction force acting upon the particle in this case is once again directed towards the focal point. Thus, the lateral trapping force and the longitudinal force act in concert to push the particle towards the center of the light beam where it eventually comes to equilibrium.

To reiterate, optical trapping of transmissive particles is based on the principle that light imparts a change in momentum when it is refracted through a small particle. This change in momentum imparts a small force on the particle. If the light is uniform, then the refraction from the particle is the same in all directions, and no net force is imparted. However, if there is a strong intensity gradient in the light (usually laser) beam, then the forces can be unbalanced if the particle is not centered in the optical beam. While the net force is relatively small, for microscopic particles the mass of the particle is low enough that the net force is sufficient to lock it in place.

Optical trapping was first demonstrated by Ashkin at Bell Labs in the late 1960's, A. Ashkin, "Acceleration and trapping of particles by radiation pressure", *Phys. Rev. Lett.* 24:156 (1970), but not applied to biological systems until relatively recently, A. Askin, et al., "Optical trapping and manipulation of viruses and bacteria", *Science* 235:1517 (1987); A. Ashkin, et al., "Optical trapping and manipulation of single cells using infrared laser beams", *Nature* 330:769 (1987); and U.S. Pat. No. 4,893,886, to A. Ashkin, et al., entitled "Non-destructive optical trap for biological particles and method of doing same", issued Jan. 16, 1990. This art has been studied and practically applied in a variety of ways. T. C. B. Schut, et al., "Experimental and theoretical investigation on the validity of the geometrical optics model for calculating the stability of optical traps", *Cytometry* 12:479 (1991); G. Roosen, et al., "The $TEM_{01}$* mode laser beam—a powerful tool for optical levitation of various types of spheres", *Opt. Comm.* 26:432 (1978); and Cell Robotics, Inc., LaserTweezers™ device.

Although biological particles are generally not spherical, the same physical principles governing optical trapping apply to them. An infrared laser is generally used as the trapping laser, since biological materials typically do not absorb in the IR, thus minimizing the chance that the biological samples might be inadvertently damaged or destroyed. Instrumentation based on the principle of optical trapping is commercially available from Cell Robotics, Inc., and is sold under the trademark LaserTweezers. A schematic of this product is shown in FIG. 6. The device consists essentially of a computer-controlled, motorized XY stage, a Z-drive, a laser module and a camera, all of which are directly mounted onto a microscope. The laser light is steered through the microscope so that the beam fills the rear aperture of the objective, resulting in a tightly focused beam suitable for optical trapping. The trap is formed at the focal point of the laser beam, as discussed above. Since the laser alignment is fixed, moving the trapped particle within the XY plane is accomplished by moving the XY stage. The stage has a resolution of 0.1 micron and a repeatability of 1 micron, so that measurements can be controlled. Motion along the Z-axis, on the other hand, is controlled with the Z-drive which moves the microscope objective up and down. The contents of the manipulation chamber can be viewed with an eyepiece or a camera, both of which are mounted to the microscope and are protected by an infrared blocking filter.

Although the LaserTweezers optical trapping technique is a very useful one, its utility is generally restricted to those situations in which the object to be trapped is at least semi-transparent and has an index of refraction greater than that of the surrounding medium. This is because for a reflective particle, the forces act in exactly the opposite direction. Instead of being trapped, the reflective particle is pushed away. There are limited exceptions to this, however. Roosen, et al. have used a $TEM_{01}$* mode laser beam to optically levitate metallic spheres. This technique, however, can only be used provided that the laser beam diameters are in certain mathematical proportions. In addition, two laser beams may be required in some situations for optical levitation to occur. Also, Svoboda and Block have demonstrated that small metallic particles can be trapped with optical tweezers, but only when the particles have radii much smaller than that of the wavelength of the trapping light (the so-called Rayleigh regime). K. Svoboda, et al., "Optical trapping of metallic Rayleigh particles", *Optics Lett.* 19:930 (1994). For example, stable traps were formed with gold and latex particles having diameters of 36 and 38 nm, respectively.

Thus, the most common optical trapping techniques rely on the particle being transmissive to the light. However, for a reflective particle, the forces operate in exactly the opposite direction, and instead of the light beam trapping the particle, it is accelerated away rapidly. Only very small particles (those that are smaller than the wavelength of light) can be trapped using a single light beam. K. Svoboda, et al., "Optical trapping of metallic Rayleigh particles", *Optics Lett.* 19:930 (1994). Roosen, et al. have used $TEM_{01}$* laser beams to create small traps for reflective particles. However, these beams are determined by the mode pattern of the laser, and are not easily matched to the particle size in any convenient fashion.

To date, only one technique has been proposed which addresses the problem of how to optically trap reflecting particles or particles which have an index of refraction less than that of surrounding medium. K. Sasaki, et al., "Optical trapping of a metal particle and a water droplet by a scanning laser beam", *Appl. Phys. Lett.* 60:807 (1992); and U.S. Pat. No. 5,212,382, to K. Sasaki, et al., entitled "Laser trapping and method for applications thereof", issued May 18, 1993. Sasaki, et al. have disclosed the method of FIG. 1(*c*), which involves scanning a focused laser beam around the particle to be trapped. The scanned beam forms a "reflective cage of light" around the particle, effectively confining it within the light cage. The case of reflecting particles is analogous to the solar wind phenomenon where photons act to push away particles. Likewise, transmissive particles with indices of refraction lower than that of the surrounding medium are trapped as well, as can be seen by a conservation of momentum analysis analogous to that presented in connection with FIG. 1(*b*). In this case, the momentum imparted to the particle pushes it away from regions of higher light intensity, or in other words, towards the center of the "doughnut hole" defined by the scanning laser beam.

The method of Sasaki, et al. suffers from limitations, however. The laser must be scanned fast enough to overcome diffusion of the particle out of the light cage. Thus, the viscosity of the solvent and the size of the particles determine which combinations of particles and solvent media can be used. There is the cost and complexity introduced by the scanner and associated hardware. In addition to the elements needed to inject the laser beam into the microscope, a scanning mirror must be included in the optical system. This mirror must operate at a high enough bandwidth that the particle cannot escape in the time it takes to complete a circle. Further, the scan system can introduce vibrations or other errors into the system.

The present invention circumvents the restrictions of the prior art light cage apparatuses to permit direct and straightforward manipulation of reflective particles of many sizes without a complex scanning system.

SUMMARY OF THE INVENTION

DISCLOSURE OF THE INVENTION

The present invention is a method and apparatus for containing either a reflective particle or a particle having an index of refraction lower than that of the surrounding media. The method comprises the following steps: identifying a focal plane proximate the particle; illuminating an optic system with a single beam of light, where the optics system consists of optical elements and a single exit aperture and simultaneously generating from the aperture at least three discrete focussed beams of photons, each of the individual beams comprising a single focal spot proximate the focal plane. The set of focal spots defines a ring which surrounds the particle and the set of beams circumscribe a space within which the particle lies. This induces constraining forces created by radiation pressure that are applied to the particle by the surrounding beams and contain the particle in a three-dimensional force field trap. A diffractive element, such as a Dammann grating or an aperture multiplexed phase element, combined with a separate focusing lens, may be employed to generate the beams. A substantially continuous boundary or ring of focal points may be generated rather than discrete spots. A zoom lens or like means may be used to vary the size of the space, permitting reflective particles of varying sizes to be contained. The beam generation may employ an aperture multiplexed lens, which eliminates the need for a separate focusing lens element. Preferably, the interstices between the focal spots are smaller than the reflective particle. The beam generation employs neither scanning nor moving structural elements.

A primary object of the present invention is to provide a light or radiation cage method and apparatus for use with reflective particles and particles having an index of refraction lower than that of the surrounding media.

A primary advantage of the present invention is that it may trap particles of a size not limited by the wavelength of the radiation employed.

Another advantage of the present invention is that no scanning mirror equipment or active feedback position control mechanisms are required, lessening complexity, cost, and errors introduced by vibration.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings:

FIG. 1(*b*) illustrates prior art longitudinal optical trapping;

FIG. 1(*c*) illustrates a prior art method for creating a light trap for reflective particles;

DESCRIPTION OF THE PREFERRED EMBODIMENTS

BEST MODES FOR CARRYING OUT THE INVENTION

The present invention is a method and apparatus for trapping a reflective (or low index of refraction) particle without the use of a scanning mirror, multiple light sources, or active feedback control mechanism. Throughout the specification and claims, the word "reflective" means either reflective or having an index of refraction lower than the surrounding media, unless stated otherwise.

Figure 1A:
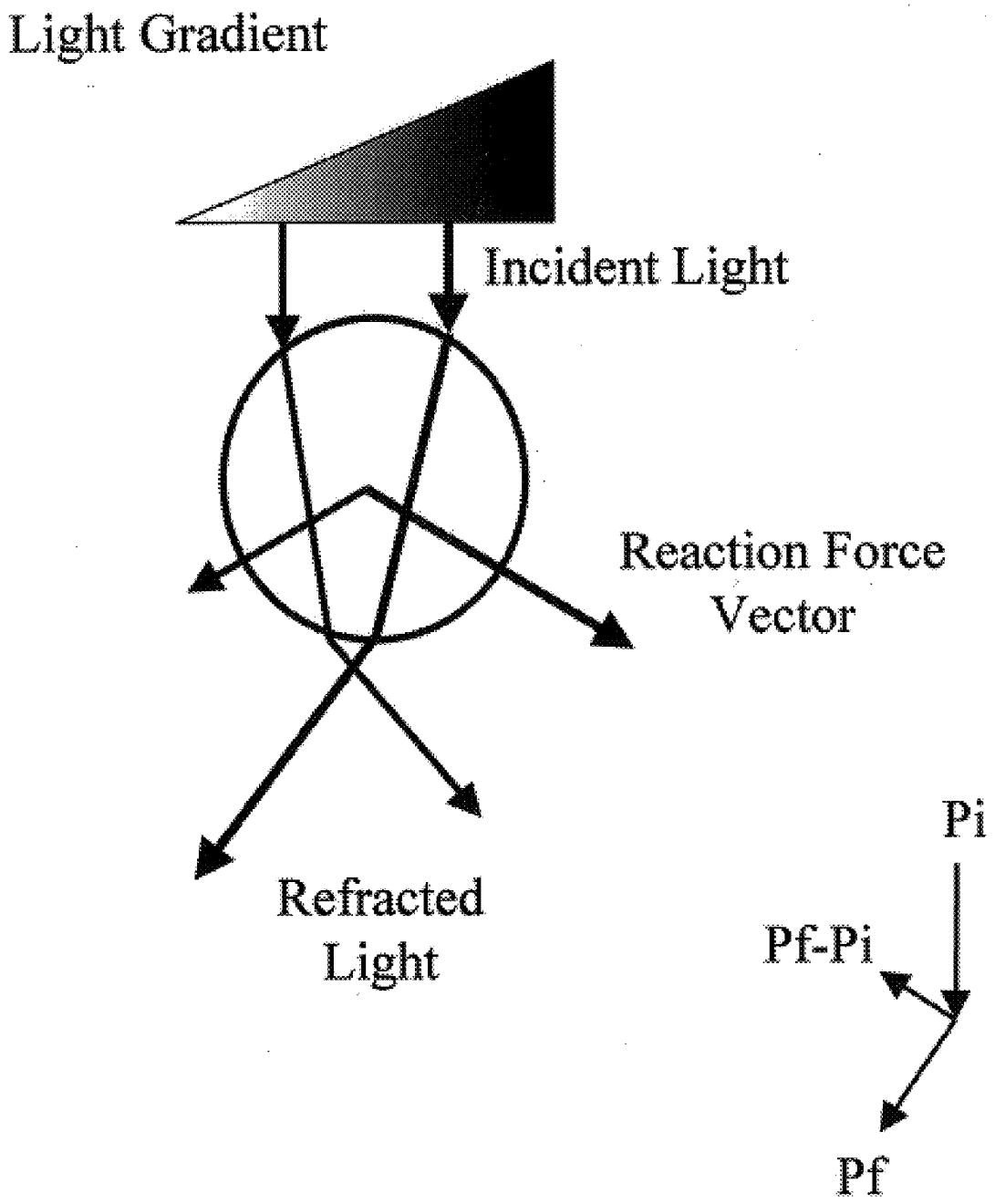
PRIOR ART FIG. 1a
FIG. 1(*a*) illustrates prior art two-dimensional (lateral) optical trapping.
Figure 1B:
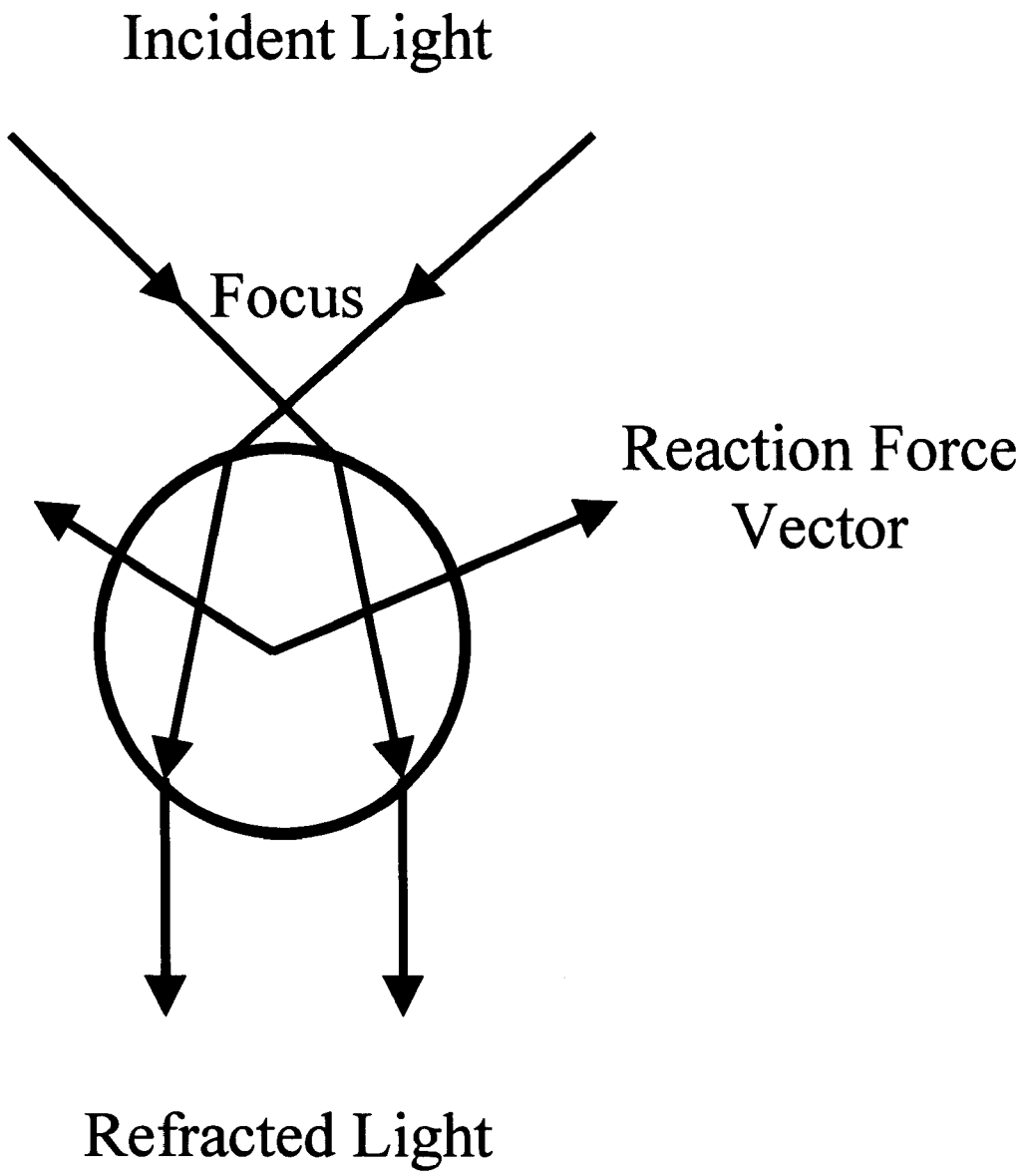
PRIOR ART FIG. 1b
Figure 1C:
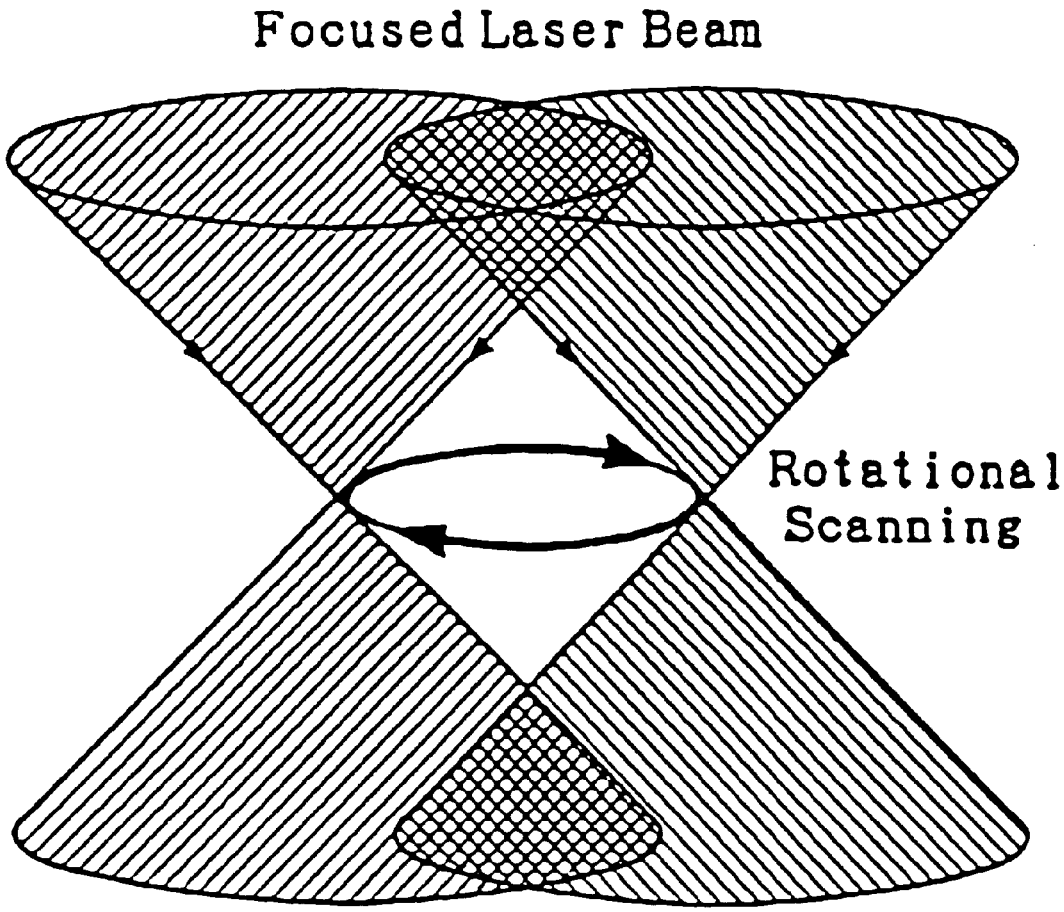
PRIOR ART FIG. 1c
Figure 2:
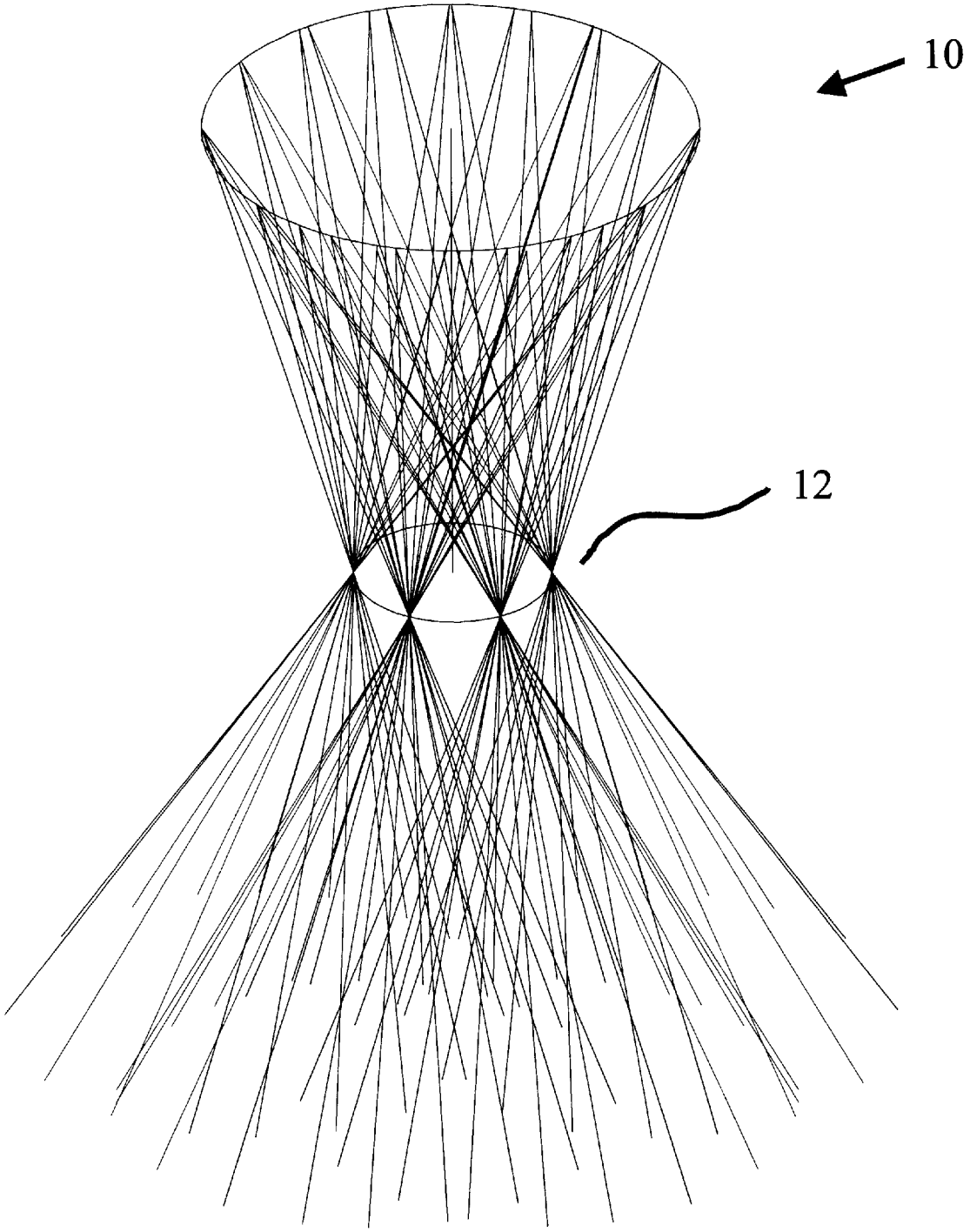
FIG. 2 illustrates the reflective particle light cage 10 of the invention having four focal spots 12.
Figure 3:
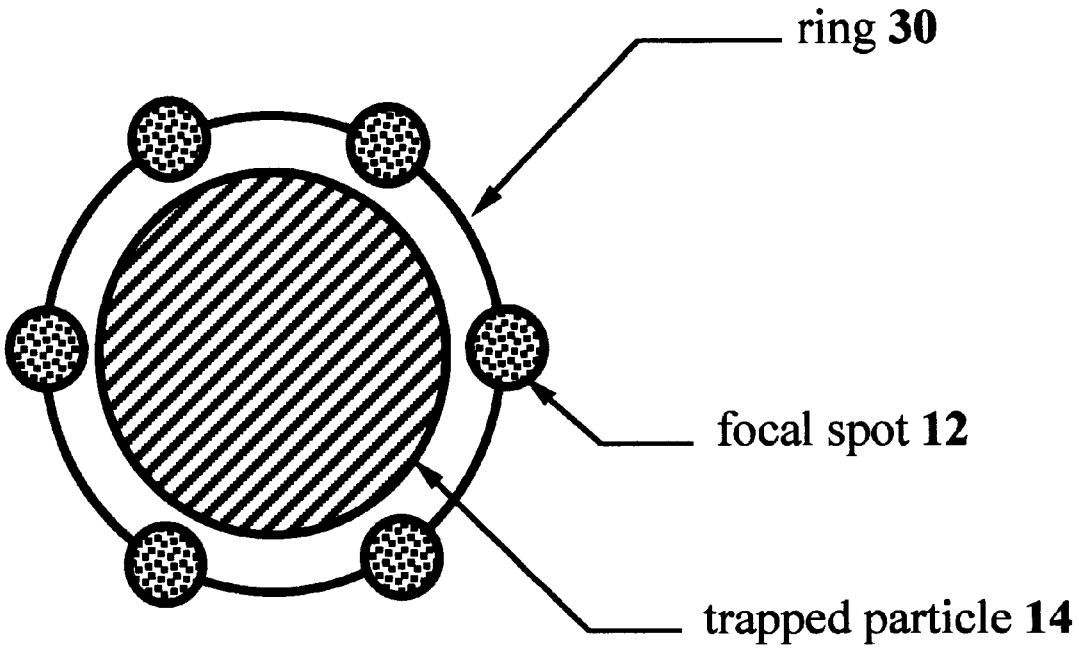
FIG. 3 illustrates the hexagonal pattern of spots 12 created by an aperture multiplexed lens having a 48×48 array of facets according to the invention.
Figure 4:
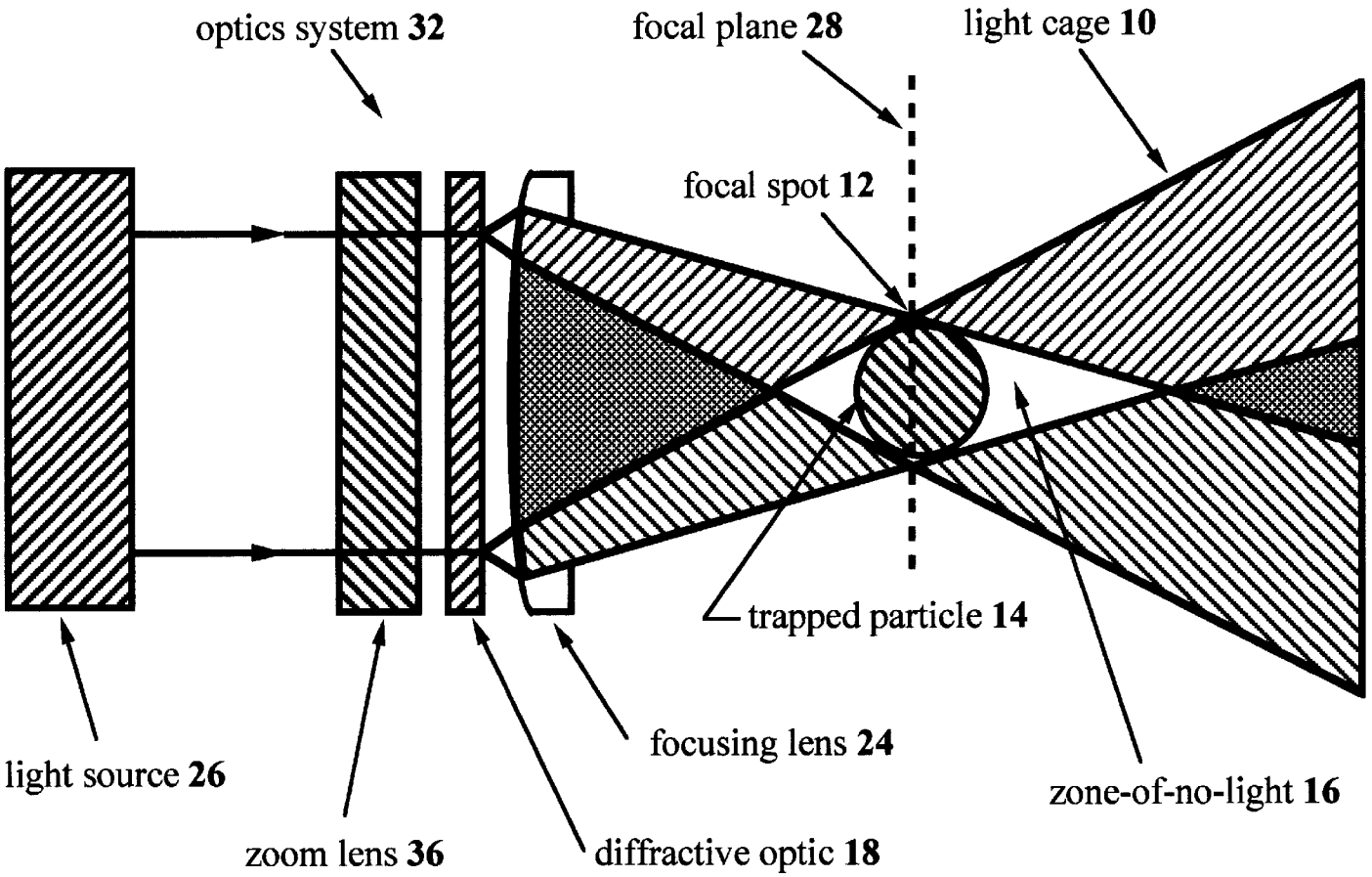
FIG. 4 schematic s trapping of a particle 14 in a three-dimensional light cage 10.

FIG. 4 schematically illustrates the preferred embodiment of this invention. A light beam from single source 26 illuminates an optics system 32. The diffractive element 18 generates a number of discrete focussed beams that are collected by a focusing lens 24. These beams emanate from a single exit aperture of system 32 and focus on to a focal plane 28 located close to the particle 14. The set of focal spots 12 defines a ring 30 in the focal plane 28 that surrounds the particle (as shown in FIGS. 2 and 3). The set of focussed beams create a "light cage" 10 and circumscribe a zone-of-no-light 16 within which the particle lies. The surrounding beams apply constraining forces (created by radiation pressure) to the particle, thereby containing it in a three-dimensional force field trap. At least three focussed beams are required to provide passive stability within the light cage 10, with greater stability being achieved as the number of focussed beams is increased, up to the practical limit of a substantially continuous boundary of focal spots. FIG. 4 also illustrates schematically an optional zoom lens means 36, which can be used to adjust the size of the ring of spots. Because the light from each spot originates from the same aperture, there are several cones of light that are converging on the same focal plane. Initially these cones of light intersect, but as they near the focal plane they separate. Thus, the only region without illumination is a double cone 16 (see FIG. 4) near the focal plane. A reflective particle 14 will be trapped in this region. Because of the strong focusing component (which arises naturally for microscope systems with high numerical aperture), the trap is truly three dimensional, and manipulation of the laser beam or other radiation source 26 (pointing and focus) will allow the user to control the position of the particle in three dimensional space.

Figure 5:
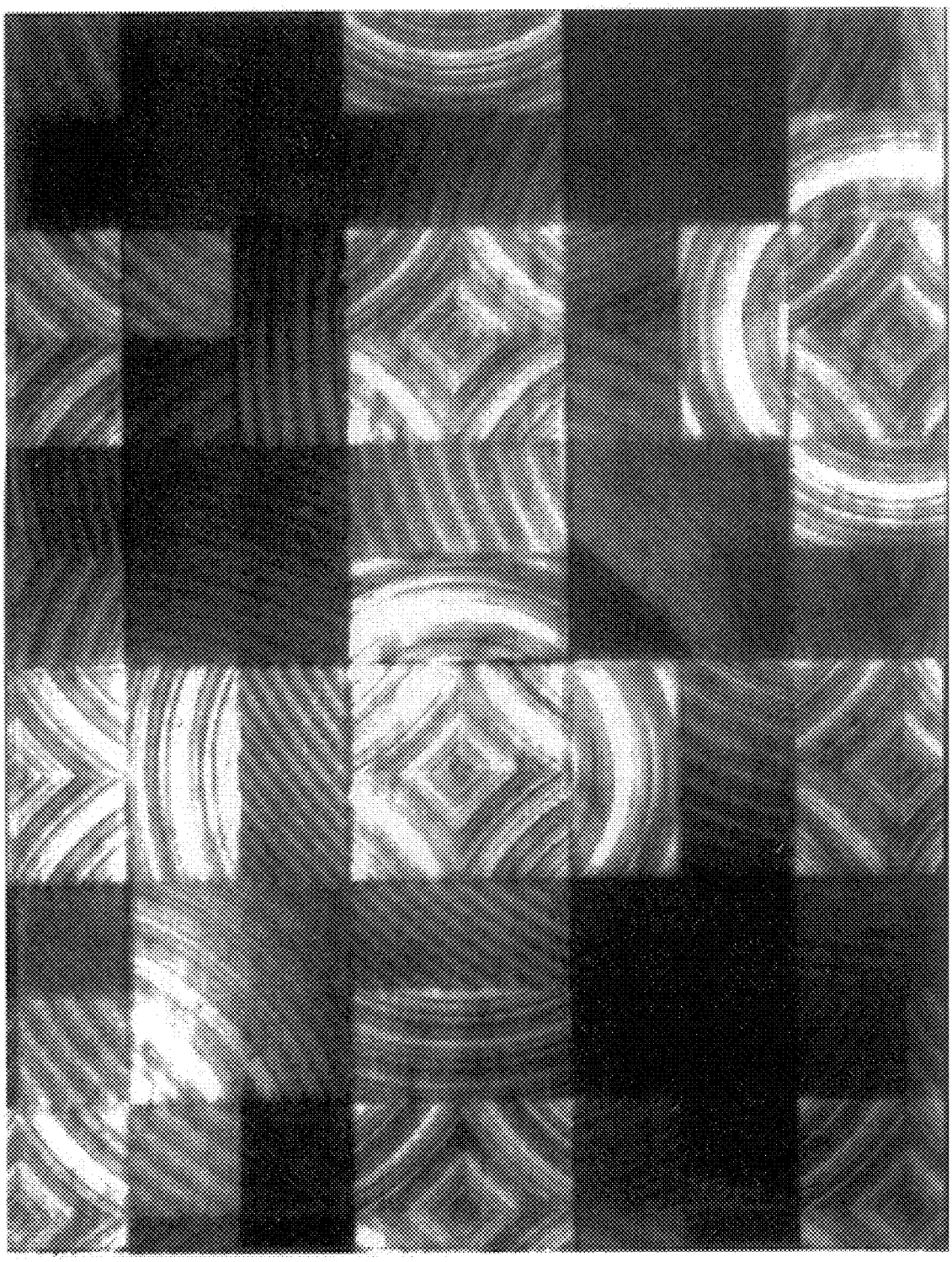
FIG. 5 is a photomicrograph from a portion of an aperture multiplexed lens 20, with each facet 22 forming a complete off-axis lens element.

There are several methods and optics 18 for creating such a distribution of light, including: (1) A diffraction pattern (known as a Dammann grating) whereby light is radially diffracted into several different directions. The light from this diffraction grating is then collected with a single focusing lens 24. The resulting light distribution will match that of FIG. 2. (2) The aperture of a phase mask can be broken up into a number of small facets. Using the techniques of binary optics, a different diffraction grating element can be fabricated in each facet. If the number of facets is large enough, then the light will be uniformly sampled across the aperture. This technique is known as faceted (segmented) aperture multiplexing because the same aperture can be used for a number of different operations. The light emanating from this aperture multiplexed phase element is collected with a focusing lens 24. (3) Using the above described technique of faceted (segmented) aperture multiplexing, the appropriate off-axis lens element can be built into each facet 22, thereby eliminating the need for a separate focusing lens element 24. An example of such an aperture multiplexed lens element 20 is presented in FIG. 5.

Figure 7:
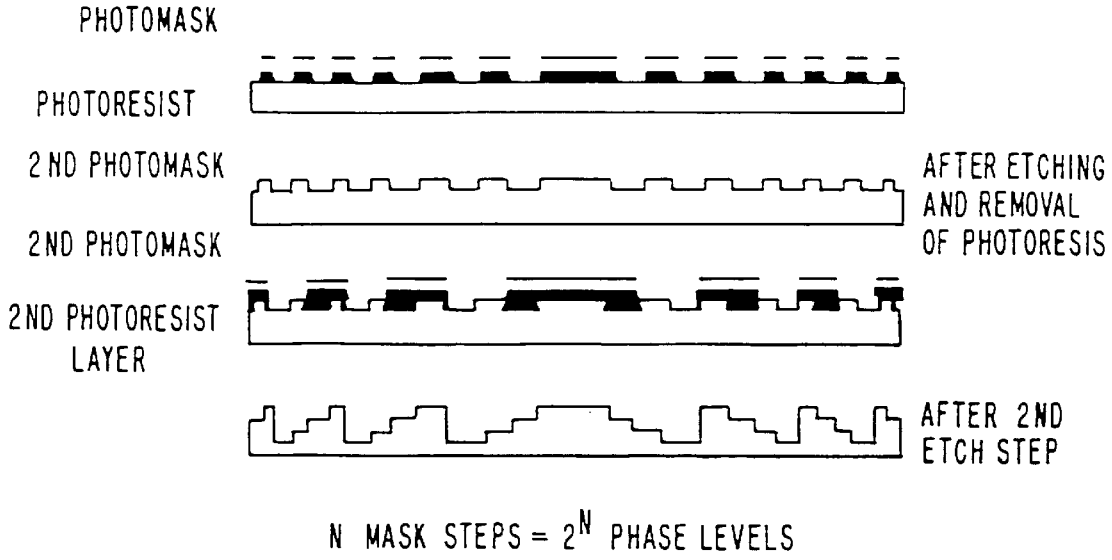
PRIOR ART FIG. 7
FIG. 7 illustrates the sequential fabrication steps in making a typical binary optical element (prior art)

A key element of the preferred optical trapping method and apparatus outlined above is binary (or diffractive) optics technology. Accordingly, this technology will be briefly described. (For an overview of this technology, see *Diffractive and Miniturized Optics* (Critical Reviews of Optical Science and Technology vol. CR49), S. H. Lee, ed., SPIE Optical Engineering Press (July 1993)). Binary optics technology differs fundamentally from the traditional approach of fabricating optical components which relies on cutting, grinding, and polishing optical material into the desired finished product. In contrast, binary optics are wholly new types of devices which are created by successively etching various levels into a substrate. In this sense, the techniques used to fabricate binary optical components are similar to those used in the manufacturing of integrated circuits. This concept is illustrated in FIG. 7, which shows how successive etching steps are used to fabricate an individual optical element. Basically, a photoresist layer is deposited on a substrate and then selectively irradiated with the help of a photomask. Etching and removal of the photoresist creates a series of etch steps (either peaks or valleys—hence the name "binary optics"). This process can be repeated several times until the desired surface is produced. For Fresnel and high f-number optics, four runs are generally sufficient to create highly efficient optics having micron-size features and arbitrary surfaces. By itself, a single, micron-size optical component might not be especially useful. These components can be combined into arrays, however, to form a variety of macroscopic optical devices, such as diffraction gratings, computer generated holograms, and lenslet arrays. Binary optics are attractive not only because they are compact but also because of their potential for low cost batch production.

Figure 8:
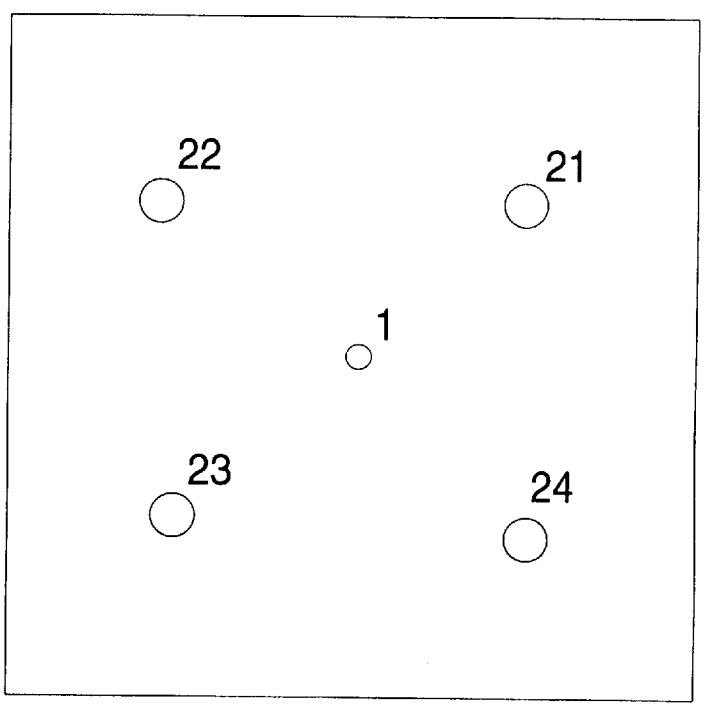
PRIOR ART FIG. 8
FIG. 8 illustrates an exemplary two-tier lens arrangement for segment aperture multiplexing using 16 segments per quadrant (prior art).
Figure 8:
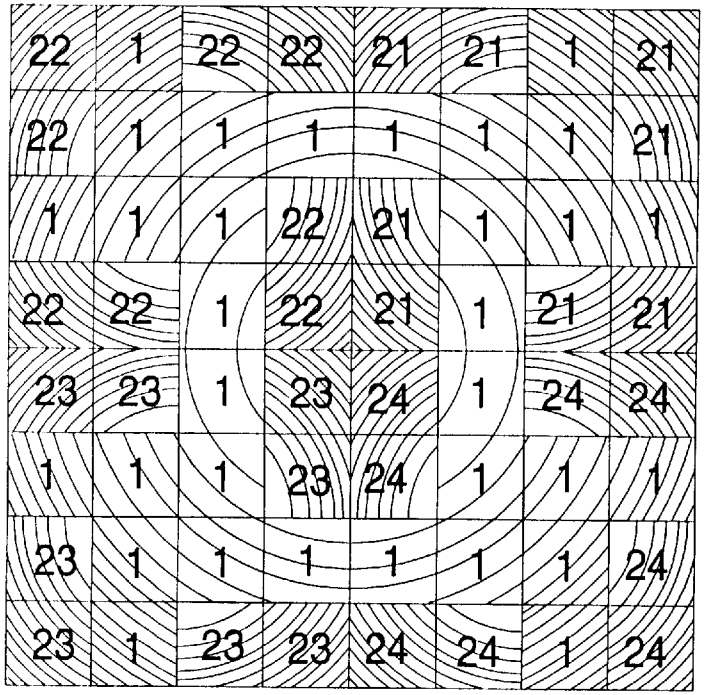
PRIOR ART FIG. 8

In principle, arbitrary surface profiles and aperture shapes can be fabricated. For example, a precisely desired spherical shape can be specified, and furthermore, the lens itself need not be round but can be rectangular or irregularly shaped. The only limitations on what can be produced are the total surface height that can be etched (approximately 2 microns), the minimum feature size, and the total amount of data required to write the mask. In practice, however, these do not represent significant restrictions. The lenslet array in FIG. 8 is an example of the type of element that can be fabricated. D. R. Neal, et al., "A Multi-tiered wavefront sensor using binary optics", *SPIE* 2201:574 (March 1994). Note that the aperture in FIG. 8 is split into a number of facets, each of which can serve a different function. Some of the facets have been designed to form off-axis lenses which focus onto the center of a detector (not shown), whereas others focus to the center of quadrants or sub-quadrants. Thus, in this example, the various subapertures work together to act as a hierarchical wavefront sensing structure. Because the fabrication method is accurate to within 0.1 micron, various facets of the aperture can be made to add coherently in the image plane. A usable device can be constructed provided that a sufficiently large number of facets is chosen, which then becomes just a straightforward optical engineering problem using faceted or segmented aperture multiplexing.

Accordingly, under the present invention a binary optical component can be fabricated based on the "reflective cage of light" principle discussed above. The modeling results of FIG. 3 show a pattern of 6 spots generated from a laser beam incident on an aperture consisting of a 48 by 48 matrix of facets. In this case, each individual facet focuses to one (but only one) of the six spot locations shown in FIG. 3. Which facets focus to a particular spot are preferably chosen randomly, so that the facets contributing to any one spot are distributed uniformly throughout the aperture. When the number of facets is too low, spurious diffraction effects in the far-field can arise. This problem is mitigated when a large number of facets (such as the 48×48 matrix considered here) is used. Although the number of spots in this example was purposely chosen to be small (only six) for the sake of simplicity, it is straightforward to design an aperture which would produce an arbitrary number of focal spots.

The focusing arrangement discussed here forms a three dimensional reflective cage of light which traps particles having diameters greater than the distance separating adjacent spots. This is more easily conceptualized with the aid of FIG. 2. Since each spot is formed from light coming from any facets of the aperture and thus from all different angles, there exist regions of high light intensity both before and after the focal plane, and a "light hole" through which no light passes is formed. Modeling may be performed to include the regions just outside the focal plane, permitting evaluation of trapping forces and hence design of maximally efficient optical traps for any given application.

FIG. 4 shows the methods for (1) and (2) above, where the diffractive optic 18 is a separate element from the focusing lens 24. Under appropriate limits, all three techniques will produce the same results. With very small facets (10 $\mu$m or so) all three techniques converge since the Damman gratings are designed using a finite unit cell that appears in much the same fashion as the faceted aperture multiplexing. FIG. 3 presents an example of the spot pattern created from a 48×48 array of facets using the techniques of (2) or (3) above. This ring of spots 12 may be re-imaged through the microscope to whatever size was appropriate for the particle under study. Using a zoom lens arrangement 36 it is also possible to start with a relatively large ring and then shrink it in size to match the particle size. A diffractive structure that produces a ring of light may be fabricated with conventional photolithography and etching techniques used by those familiar with the art.

Figure 6:
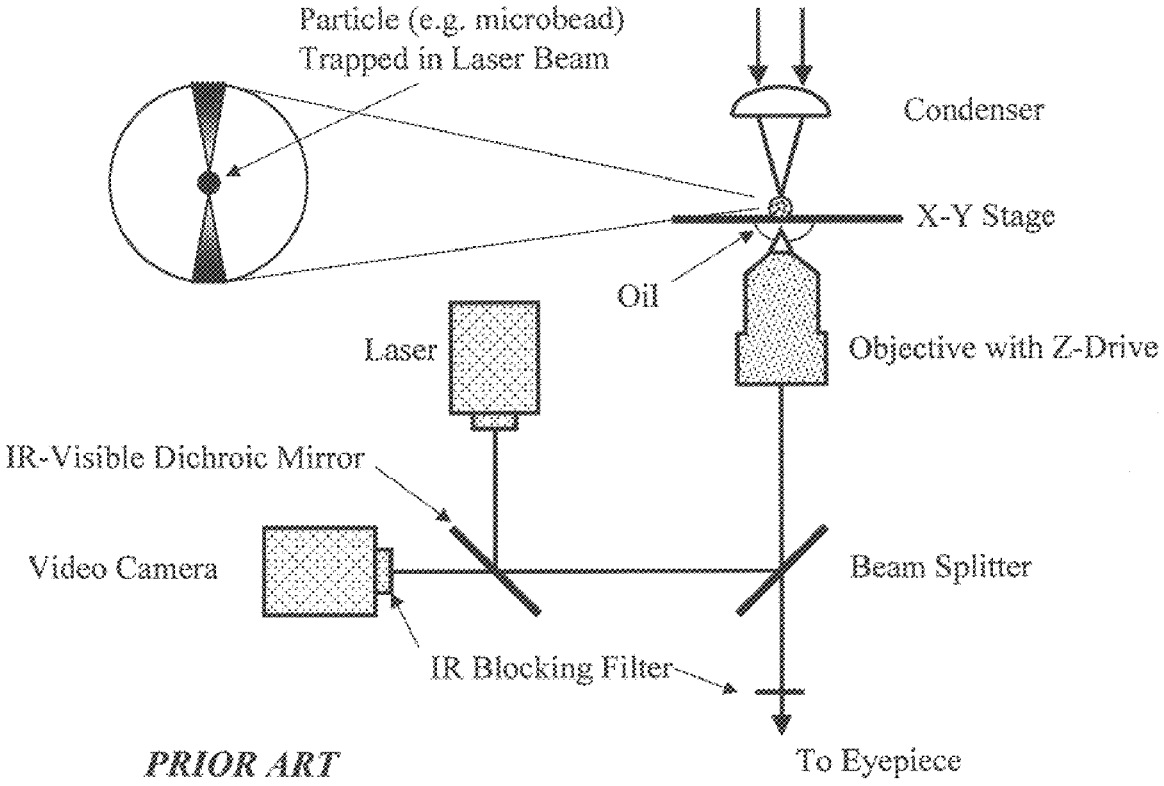
PRIOR ART FIG. 6
FIG. 6 schematically illustrates the LaserTweezers device of Cell Robotics, Inc., (prior art)

The present invention may be usefully employed with the prior art LaserTweezers™ apparatus (see FIG. 6), which may then be used as a general means of trapping particles which are reflecting or which have a index of refraction lower than that of their surrounding medium. Such a device complements the existing Cell Robotics, Inc., technology described above. Instead of relying on a scanning laser beam as in the work of Sasaki, et al., laser light is focused preferably by lenslet arrays into multiple cones of light to form the reflective cage of light around the particle to be trapped.

The present invention is generally useful in the areas of genetics, environmental science, environmental science, forensics, chemistry, and materials science, among others which will occur to those skilled in the art. The most exciting applications may well be in the areas of medicine and biology, where the present invention may be used to manipulate stained chromosomes and cells having reflective properties or indices of refraction which are lower than their surrounding media. This would have an immediate impact on the human genome project, for example. Applications in the fields of materials science include manipulation of crystals at the microscopic level. Further, a common technique in cell and molecular biology is the "tagging" of antibodies with metallic or magnetic substances. These substances then function as "handles" which can be used to localize the sites to which the antibody adheres, where the sites can be specific molecules within cells or viruses, or specific regions within large molecules such as DNA and RNA. In this manner, the objects to which the antibodies are attached can be isolated and separated. In many other biological and medical applications, the staining of cells, parts of cells, or chromosomes changes the reflectivity or even the index of refraction of the material being stained.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, and of the corresponding application(s), are hereby incorporated by reference.

What is claimed is:

1. A method of containing a particle selected from the group consisting of reflective particles or particles having an index of refraction lower than that of the surrounding media; the method comprising the steps of:

a) identifying a focal plane proximate the particle;

b) illuminating an optic system with a single beam of light, said system consisting of optical elements and having a single exit aperture;

c) simultaneously generating from said exit aperture at least three discrete focused beams of photons, each of the beams comprising a single focal spot proximate the focal plane, the focal spots defining a ring which surrounds the particle, the beams circumscribing a space within which the particle lies;

whereby the particle is surrounded by the focused beams of photons.

2. The method of claim 1 wherein the generating step comprises employing a diffractive element.

3. The method of claim 2 wherein the diffractive element comprises a Dammann grating in combination with a focusing lens.

4. The method of claim 2 wherein the diffractive element comprises an aperture multiplexed lens.

5. The method of claim 2 wherein the diffractive element comprises a phase element in combination with a focusing lens.

6. The method of claim 1 wherein the generating step comprises generating a substantially continuous boundary of focal spots.

7. The method of claim 1 additionally comprising the step of employing zoom means to vary the size of the space, permitting particles of varying sizes to be contained.

8. The method of claim 7, wherein the method of capturing the particle comprises the steps of:

a) adjusting the zoom means so that the diameter of the ring of focal spots is initially substantially larger than the particle's size;

b) placing the particle inside of the ring, proximate the focal plane;

c) reducing the diameter of the ring by adjusting the zoom means until the ring's diameter substantially matches the particle's size.

9. The method of claim 1 wherein the generating step comprises insuring that interstices between the focal spots are smaller than the particle.

10. The method of claim 1 wherein the position of the trapped particle in three-dimensional space is controlled by manipulation of the light source.

11. An optical apparatus for containing a particle selected from the group consisting of reflective particles or particles having an index of refraction lower than that of the surrounding media; said apparatus comprising:

a focal plane proximate the particle; and means for simultaneously generating from an optical system having a single exit aperture at least three discrete focussed beams of photons, each of said beams comprising a single focal spot proximate said focal plane, said focal spots defining a ring which surrounds the particle, the beams circumscribing a space within which the particle lies;

whereby the particle is surrounded by the focused beams of photons.

12. The apparatus of claim 11 wherein said generating means comprises a diffractive element.

13. The apparatus of claim 12 wherein the diffractive element comprises a Dammann grating in combination with a focusing lens.

14. The apparatus of claim 12 wherein the diffractive element comprises an aperture multiplexed lens.

15. The apparatus of claim 12 wherein the diffractive element comprises a phase element in combination with a focusing lens.

16. The apparatus of claim 11 wherein said generating means comprises means for generating a substantially continuous boundary of focal points.

17. The apparatus of claim 11 additionally comprising zoom means for varying said size of said space, permitting particles of varying sizes to be contained.

18. The apparatus of claim 11 wherein the interstices between said focal spots are smaller than the particle.

19. The apparatus of claim 11, additionally comprising means for controlling the position of the trapped particle in three-dimensional space by manipulating the light source.

* * * * *